United States Patent [19]

Anable

[11] 3,930,489

[45] Jan. 6, 1976

[54] HEATING SYSTEM

[76] Inventor: Fred A. Anable, 18 Flynt Ave., Monson, Mass. 01057

[22] Filed: Mar. 5, 1975

[21] Appl. No.: 555,386

Related U.S. Application Data

[63] Continuation-in-part of Ser. No. 457,550, April 3, 1974, abandoned.

[52] U.S. Cl. ..... 126/99 R; 126/110 R

[51] Int. Cl.[2] ..... F24H 3/00

[58] Field of Search..... 126/99 R, 99 D, 99 C, 114, 126/110 R, 110 A, 110 B; 165/137, DIG. HS; 237/54, 55

[56] References Cited

UNITED STATES PATENTS

| | | | |
|---|---|---|---|
| 1,519,673 | 12/1924 | Doble | 126/99 R |
| 1,530,809 | 3/1925 | Bowman | 126/99 R |
| 1,558,848 | 10/1925 | Doble, Jr. | 126/99 R |
| 1,966,360 | 7/1934 | Shaffer | 237/55 |
| 2,386,746 | 10/1945 | Hess | 126/99 R |
| 2,425,630 | 8/1947 | McCollum | 126/110 R |
| 2,789,520 | 4/1957 | Rowland | 126/110 R |
| 2,891,535 | 6/1959 | Frey | 126/110 R |

*Primary Examiner*—William F. O'Dea
*Assistant Examiner*—Henry C. Yuen
*Attorney, Agent, or Firm*—Ross, Ross & Flavin

[57] ABSTRACT

A system for utilizing furnace waste stack pipe heat which comprises elongating the waste stack pipe so that it defines a substantially rectangular shape and, when a blower is used in conjunction with the furnace, so that it extends over the blower in order that air drawn into the blower is preheated, the system further including placing a cover or hood over the elongated waste stack pipe and a baffle plate thereunder, each in close proximity thereto, for forcing the currents of air to move in close proximity to the hot waste stack pipe to readily absorb the heat therefrom.

2 Claims, 4 Drawing Figures

HEATING SYSTEM

This is a continuation-in-part of my copending application, Ser. No. 457,550, filed Apr. 3, 1974, now abandoned.

A primary purpose of the invention is to provide a system for recovering and utilizing a great percentage of waste stack pipe heat, thereby providing large savings in heating costs.

The system of the invention may be utilized with furnaces of the hot air or other types, such as steam or hot water, and may be easily installed as an inexpensive addition to existing heating systems.

Figure 2:
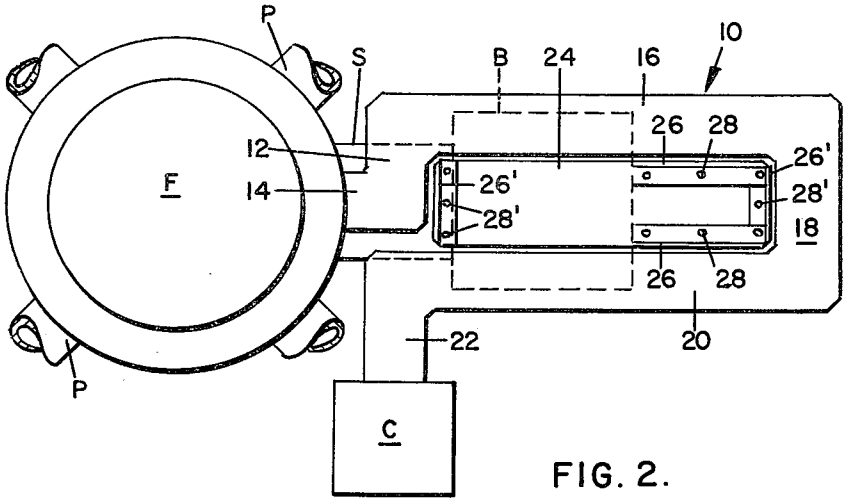
FIG. 2 is a view in top plan of the heating system of FIG. 1, with the hood removed.
Figure 1:
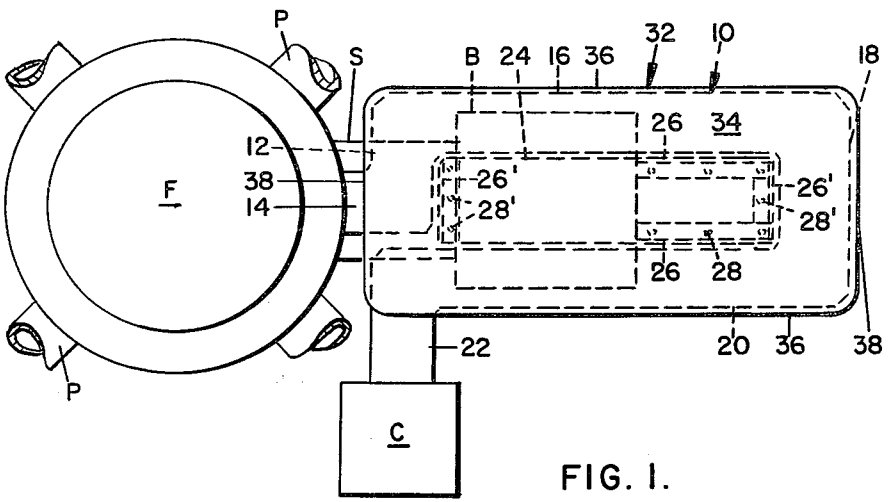
FIG. 1 is a view in top plan of a heating system incorporating a preferred form of the invention.
Figure 4:
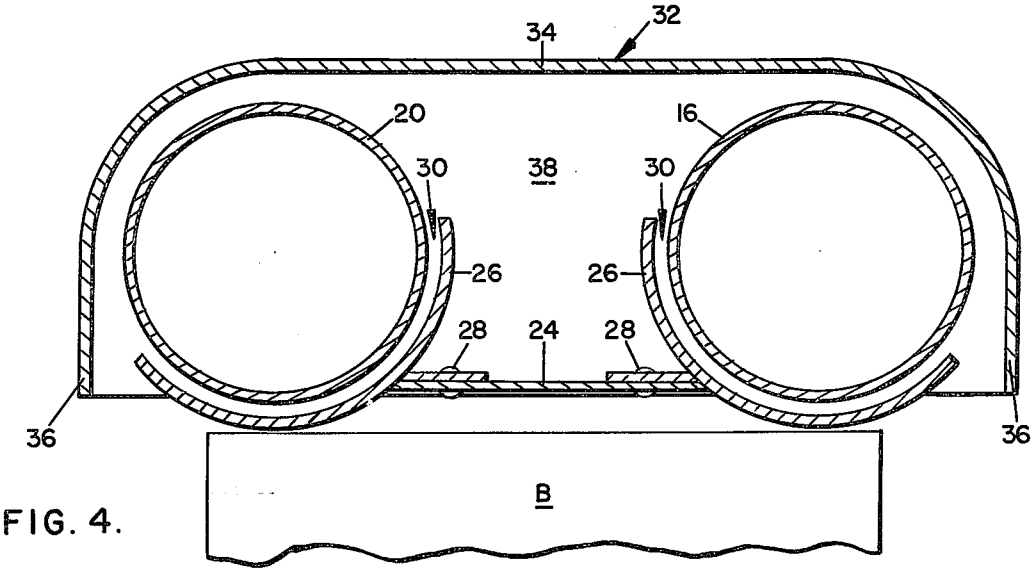
FIG. 4 is an enlarged somewhat diagrammatic, transverse cross-sectional view of the heating system of the invention.
Figure 3:
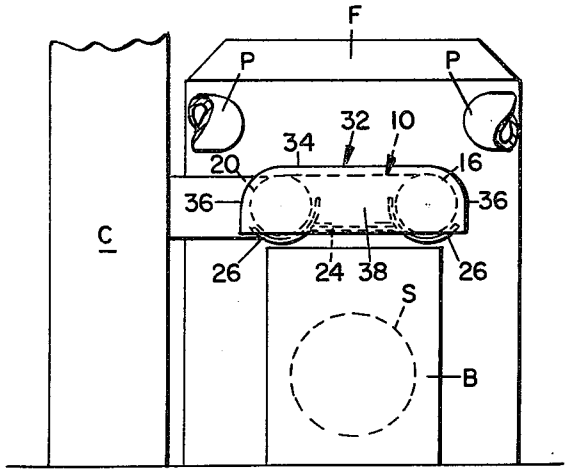
FIG. 3 is a view in end elevation of the heating system of the invention, as seen from the right of FIG. 1.

In the typical prior art heating system, air is fed to a furnace by a blower through an inlet stack, with exhaust gases passing directly from the furnace through a short waste stack pipe to a chimney, and with heated air passing from the furnace through heating pipes to areas in the building to be heated.

In such a prior art system, the air which is drawn from the cellar or other area surrounding the furnace is unheated, and the exhaust gases are not utilized, being passed in a direct path from the furnace to the chimney.

In the heating system of the invention, as with the prior art, air is fed to a furnace F by a blower B through an inlet stack S, with heated air passing from the furnace through heating pipes P.

Herein, however, the short waste stack pipe of the prior art is replaced by an elongated waste stack pipe 10 which is somewhat rectangular in plan, with exhaust gases passing from the furnace through the waste stack pipe to a chimney C.

Waste stack pipe 10 includes a first end portion 12 joined at one end to a furnace connector portion 14 which leads from furnace F and at its opposite end to one end of a first side portion 16 which passes horizontally over one side of blower B. First side portion 16 is joined at its opposite end to one end of a second end portion 18 which is joined at its opposite end to one end of a second side portion 20 which is parallel to first side portion 16 and passes over the other side of blower B. Second side portion 20 is joined at its opposite end to a chimney connector portion 22 which leads to chimney C.

By use of the described rectangular shape, employing sharp right angle bends, the hot exhaust gases are kept in a constant state of turbulence as they move along, constantly forcing fresh heat to the inner wall of every square inch of the waste stack pipe.

It is not mandatory that the blower be placed in the position shown in the drawing. For instance it could be placed on top of the furnace or elsewhere, the only requirement being that the blower be appropriately ducted so as to pull air through the unit hereof.

A flat metal baffle plate 24 is disposed in the space between the side portions 16 and 20 of waste stack pipe 10 substantially on a plane with the lower surfaces of said side portions, the baffle plate preferable being disposed within approximately ½ to 1 inch of the side and end portions of the waste stack pipe, thereby forcing air to pass in close proximity to the hot waste stack pipe.

In that section of the baffle plate 24 which is disposed between the blower B and end portion 18 of the waste stack pipe, arcuate deflectors 26 are fixed to the side edges of the baffle plate as by rivets 28 or the like. Similar deflectors 26' are fixed to the end edges of the baffle plate as by rivets 28' adjacent the waste stack end portions 12 and 18.

The deflectors extend partially above and partially below the plane of the baffle plate and are slightly spaced from the circumference of the respective adjacent portions 12, 16, 18, and 20 of the waste stack pipe so as to define curvilinear conduits 30 between the deflectors and the waste stack pipe portions, which conduits insure that air passes in close proximity to the waste stack pipe.

In order to increase the effectiveness of the waste stack pipe 10, it is partially enclosed in such as a cover or hood 32 fabricated from metal or other suitable material and including an upper wall 34 which overlies the waste stack pipe, side walls 36 and end walls 38 depending from upper wall 34 outboard of but in close proximity, (i.e., in the area of 1 to 1½ inches), to the adjacent portions of the waste stack pipe, the side walls curving at their upper ends where they merge with the upper wall so as to follow the contour of the waste stack pipe.

By use of the cover or hood in conjunction with baffle plate 24 and deflectors 26, curculating air is forced to move in close adjacency to the side and end portions of the waste stack pipe.

When the system of the invention, incorporating a cover or hood, a baffle plate deflector, and a waste stack pipe is utilized, warm air is directed to the furnace, the air being forced to move in close adjacency to the hot waste stack pipe for maximum heat absorption, with the turbulent hot air within the waste stack pipe being met by a constant stream of fresh cold air pressed against and running, circumferentially, by every square inch of the outer stack surface. This obviously results in maximum heat absorption.

When the burner and forced air blower stop, and furnace is hot, and convection currents continue to pull air through the system still pre-heating it with heat escaping from the inner furnace.

With the system hereof, all of the air going to the furnace must pass within approximately 1 inch of the waste stack pipe. The entire surface of the waste stack pipe is utilized with exterior air flowing within one inch thereof with the interior hot gases being continuously mixed at each bend.

The heating system of the invention is simple and inexpensive to construct and it does not send exhaust fumes down against the natural flow. Nor does it require a blower to get rid of the fumes. The system of the invention captures waste stack heat with the aid of a blower and can readily be adapted to an existing blower.

The system is far less dangerous than many of those of the prior art because of its simplicity. All one has to do is to lift off the hood to inspect for leaks. Cleaning out soot can be done by dividing the stack into two sections and washing with a garden hose.

Every inch of the waste stack pipe, both in length and circumference, has air moving therepast in very close proximity thereto, an average of one inch away. The design incorporates five right angle turns, each one remixing the hot gases so that new heat is always against the pipe surface.

The waste stack pipe preferably is fabricated from rust and corrosion resistant material using as few joints as are needed for practical fabrication. Only those joints which must be flexible for fitting purposes should be left free. All others should be permanently sealed. Upon installation, those joints which have been left free should also be well sealed but in such a way they can be unsealed for cleaning purposes.

By observing these precautions, the possibility of the blower sucking exhaust fumes out of the stack is obviated.

I claim:

1. In a heating system located in a furnace room and including a furnace and an air blower for delivering air to the furnace via an inlet stack and heating pipes for the delivery of heated air from the furnace to the areas to be heated, the improvement in means for utilizing the heat passing through from the furnace to the chimney by preheating furnace room air wiped therepast preliminary to passage thereof through the air blower and inlet stack to the furnace comprising:

an elongated horizontally disposed waste stack of generally rectangular plan for the through flow of exhaust gases from the furnace to the chimney and including, a first end portion connected at its inboard end to the furnace and having an outboard end and a first side portion connected at its inboard end to the outboard end of the first end portion and having an outboard end and a second end portion connected at its inboard end to the outboard end of the first side portion and having an outboard end and a second side portion connected at its inboard end to the outboard end of the second end portion and having an outboard end connected to the chimney, a first pair of arcuate deflectors disposed in close spaced relationship and circumadjacent the oppositely facing sections of the spaced first and second side portions of the waste stack and defining primary curvilinear air passages therebetween, a horizontally disposed baffle connecting between the arcuate deflectors of the first pair thereof, an opened bottom hood including a horizontally disposed top wall section and spaced opposite end and side wall sections depending therefrom in curving relationship therewith, the respective top and end and side wall sections of the hood being disposed in uniform spaced relationship and in close proximity to the adjacent portions of the waste stack and defining secondary curvilinear air passages therebetween, with air from the furnace room being captured and circulated first within the secondary air passages and second within the primary air passages for wiping relationship relative to the side and end portions of the waste stack.

2. In the heating system as set forth in claim 1, including, a second pair of arcuate deflectors disposed in spaced relationships circumadjacent the oppositely facing sections of the first and second end portions of the waste stack and defining tertiary air passages therebetween.

* * * * *